US005364238A

United States Patent [19]

Yu

[11] Patent Number: 5,364,238

[45] Date of Patent: Nov. 15, 1994

[54] DIVERGENT INLET FOR AN AUTOMOTIVE FUEL PUMP

[75] Inventor: Dequan Yu, Ann Arbor, Mich.

[73] Assignee: Ford Motor Company, Dearborn, Mich.

[21] Appl. No.: 116,842

[22] Filed: Sep. 7, 1993

[51] Int. Cl.[5] ..... E04D 5/00

[52] U.S. Cl. ..... 417/423.14; 415/55.1

[58] Field of Search ..... 417/423.14; 415/55.1, 415/55.2, 55.5

[56] References Cited

U.S. PATENT DOCUMENTS 4,403,910 9/1983 Watanabe et al. ..... 415/55.1
4,445,821 5/1984 Watanable et al. ..... 415/55.1
4,451,213 5/1984 Takei et al. ..... 415/55.5
4,556,363 12/1985 Watanabe et al. .

FOREIGN PATENT DOCUMENTS 1071992 9/1954 France .
3327922 2/1985 Germany ..... 415/55.1

*Primary Examiner*—Richard E. Gluck
*Attorney, Agent, or Firm*—David Kelley; Roger L. May

[57] ABSTRACT

A fuel pump has a pump cover with an inlet through which fuel from a fuel tank is drawn by an impeller to a pumping chamber formed by a pump bottom and the pump cover. The inlet has divergent sides oriented such that fuel being pumped is routed radially outward of primary vortices in a section of the pumping chamber adjacent the inlet to a section of the pumping chamber opposite the inlet. In a first embodiment, the upper side of the inlet is oriented at approximately a 10 to 12 degree angle from the lower side. In a second embodiment, the upper side is oriented at approximately a 127 degree angle from a line parallel the shaft rotation, and the lower side is oriented at approximately a 139 degree angle from the same line.

6 Claims, 2 Drawing Sheets

DIVERGENT INLET FOR AN AUTOMOTIVE FUEL PUMP

FIELD OF THE INVENTION

The present invention relates to automotive fuel pumps, and, more particularly, to a divergent fuel inlet which better routes fuel to the pumping chamber of a regenerative turbine automotive fuel pump.

BACKGROUND OF THE INVENTION

Regenerative turbine fuel pumps typically draw fuel from a fuel tank, through a fuel inlet, and into a pumping chamber. As shown in FIG. 4, the pumping chamber is formed by a pump cover 20 and pump bottom 28 enclosing an impeller 16. Primary vortices are formed on either side of the impeller 16 in the pumping chambers 60 and 62 when fuel is pumped from a fuel tank to an automotive engine. If the inlet sides 72*a* and 72*b* of fuel inlet 70 are parallel, as in U.S. Pat. No. 4,723,888 (Watanabe et al.), crossing losses occur when fuel flowing along inlet side 72*a* toward primary vortices 82 in the pumping chamber 62 opposite inlet 70 interacts with primary vortices 80 in the pumping chamber 60 adjacent inlet 70. Pump efficiency is decreased by such losses and it is desirable to alter the fuel inlet to reduce such crossing losses.

Two such inlets are shown but not described in U.S. Pat. Nos. 4,538,958 (Takei et al.) and 4,556,363 (Watanabe et al.). Takei et al. employ an angled inlet 51 and Watanabe et. al. disclose an angled inlet 6. Neither of these discuss reduction of crossing losses nor disclose the advantageous inlet angles disclosed in the present invention. U.S. Pat. No. 5,141,396 (Schmidt et al.) discloses an angled inlet 8 which would increase, rather than decrease, crossing losses due to the steep lower side angle of the inlet 8. Schmidt et al also show a flat portion on the lower side of inlet 8 near the bottom of the impeller vane. U.S. Pat. No. 2,724,338 (Roth) discloses a turbine type pump having enlarged inlets (FIGS. 6, 8, 9, 12 and 15). German Patent 2,104,495 (Schwarz) employs an angled inlet 5 and an enlarged space 3 between the inlet 5 and the pumping chamber. The inlets for these patents do not, however, contribute to reduction of the crossing losses described above.

SUMMARY OF THE INVENTION

It is an object of the present invention to overcome the drawbacks of prior fuel pump designs by providing a fuel pump inlet which has divergent sides for better routing fuel from the fuel tank to a pumping chamber such that fuel flowing to primary vortices on a side of the pumping cheer opposite the fuel inlet does not significantly interact with primary vortices on a side of the pumping chamber adjacent the fuel inlet.

Another object of the present invention is to provide a fuel pump inlet which reduces crossing losses between the primary vortices in the pumping chamber thus increasing pumping efficiency.

A further object of the present invention is to provide a fuel pump inlet having a beveled portion on a lower side near the impeller vane grooves to simplify manufacture of the pump cover through which the inlet passes.

These objects are accomplished by providing a fuel pump for supplying fuel from a fuel tank to an automotive engine, comprising a pump housing, a motor mounted within said housing having a shaft extending therefrom and able to rotate said shaft upon application of an electrical current thereto. An impeller, which is attached to the shaft for rotatably pumping fuel, has a plurality of vanes separated by a plurality of angularly shaped vane grooves. A pump bottom, mounted to the housing, has an outlet therethrough in fluid communication with a motor chamber surrounding the motor, and has an opening for allowing the shaft to pass through to connect to the impeller. A pump cover is mounted on an end of the housing and attached to the pump bottom with the impeller therebetween such that a pumping chamber is formed radially along an outer circumference of the pump cover and the pump bottom, and along the periphery of the impeller. The pumping chamber has a first section in the pump cover and a second section in the pump bottom in which primary vortices are formed when the impeller rotatably pumps fuel. The pump cover has a fuel inlet therethrough in fluid communication with the fuel tank and with the pumping chamber. The inlet has a lower side and an upper side, the lower side angled tangentially to an arc formed by the angularly shaped vane grooves at a lowest point on the vane grooves, with the upper side angled at approximately 10 to 12 degrees from a line parallel to the lower side such that the sides diverge at an end of the inlet which communicates with the fuel tank so that fuel flow is routed radially outwardly of the primary vortices formed in the first section of the pumping chamber to the second section of the pumping chamber.

In an alternative embodiment, the lower side of the fuel inlet is angled at approximately 129 degrees counterclockwise below a line perpendicular to the shaft and the upper side is angled at approximately 117 degrees counterclockwise from a line perpendicular to the shaft such that the sides diverge at an end of the inlet which communicates with the fuel tank so that fuel flow is routed radially outwardly of the primary vortices formed in the first section of the pumping chamber to the second section of the pumping chamber.

In either embodiment, the lower side has a beveled portion in communication with the vane grooves which is parallel to an axis through the shaft to simplify manufacturing.

DETAILED DESCRIPTION OF THE PREFERRED EMBODIMENTS

Figure 1:
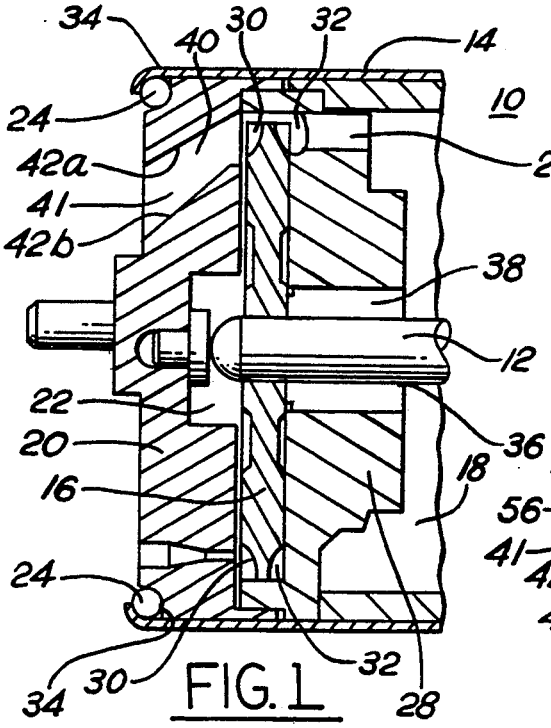
FIG. 1 is a partial cross-sectional view of a pump according to the present invention.

Referring now to FIG. 1, a fuel pump 10 has housing 14 surrounding the internal components of pump 10. A motor (not shown), preferably an electric motor, is mounted within pump housing 14 for rotating a shaft 12. An impeller 16 is fixedly attached to shaft 12 and encased within a pump bottom 28 and a pump cover 20. Impeller 16 has a central axis which is coincident with the axis of shaft 12. Tapered shoulder 34 receives O-ring 24 so that pump cover 20 fits snugly against pump housing 14. Shaft 12 passes through a shaft opening 36, through impeller 16, and into cover recess 22 of pump cover 20. Shaft 12 is journalled within bearings 38. Pump bottom 28 has a fuel outlet 26 leading from a pumping chamber 32 formed in pump bottom 28 along the periphery of impeller 16 to a motor space 18 surrounding the motor (not shown).

Figure 2:
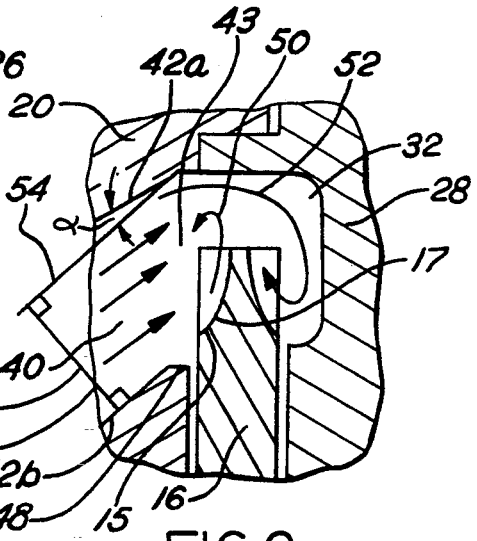
FIG. 2 is a cross-sectional view of a divergent inlet according to the present invention.

Fuel is drawn from a fuel tank (not shown) in which pump 10 is mounted through a fuel inlet 40 in pump cover 20 and into pumping chambers 30 and 32 by the rotary pumping action of impeller 16. As previously discussed, it is desirable to reduce crossing losses caused when fuel flowing from inlet 40 to pumping chamber 32 interacts with primary vortices 50 formed in pumping chamber 30. As shown in FIG. 2, fuel inlet 40 of the present invention has divergent sides 42*a* and 42*b* shaped to reduce such crossing losses. Sides 42*a* and 42*b* are angled such that fuel flows smoothly from fuel inlet 40, and radially outward of primary vortices 50 in pumping chamber 30, to form primary vortices 52 in pumping chamber 32. Side 42*b* extends tangentially to an arc formed by angularly shaped vane grooves 17 at the lowest point 15 on the vane grooves. Side 42*a* is oriented at an angle $\alpha$, which preferably is approximately 10 to 12 degrees, from a line 54 parallel to side 42*b*, as shown by line 56. With such a construction, sides 42*a* and 42*b* diverge at an end 41 of the inlet 40 which communicates with the fuel tank (not shown). Fuel flow is thus routed radially outward of primary vortices 50 formed in the pumping chamber 30 to pumping chamber 32.

The optimal angle $\alpha$ was determined through studies in which it was found that an angle $\alpha$ less than 10 to 12 degrees did not sufficiently route fuel flow radially outward of primary vortices 50 to significantly reduce crossing losses. If angle $\alpha$ was higher than 10 to 12 degrees, a nozzle effect was produced across an end 43 of inlet 40 which communicates with pumping chamber 30. In such a configuration, the fuel pressure rises as it approaches end 43, and, after passing into pumping chamber 30 or 32, suddenly decreases since the volume increases. This sudden decrease in pressure can cause fuel vapor to form within the liquid fuel. Pump efficiency, which is proportional to fluid density, would thus be reduced since the fuel vapor reduces the fuel density.

Figure 3:
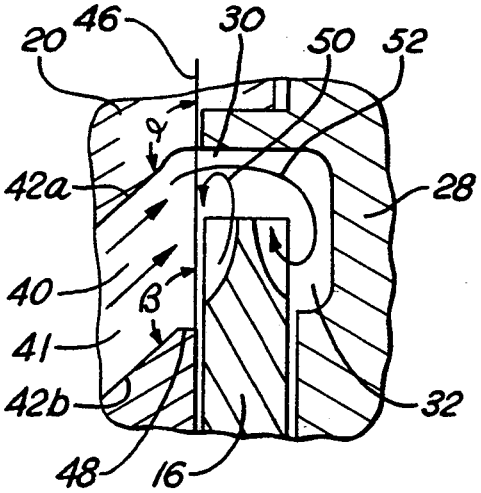
FIG. 3 is a cross-sectional view of an alternative embodiment of a divergent inlet according to the present invention.
Figure 4:
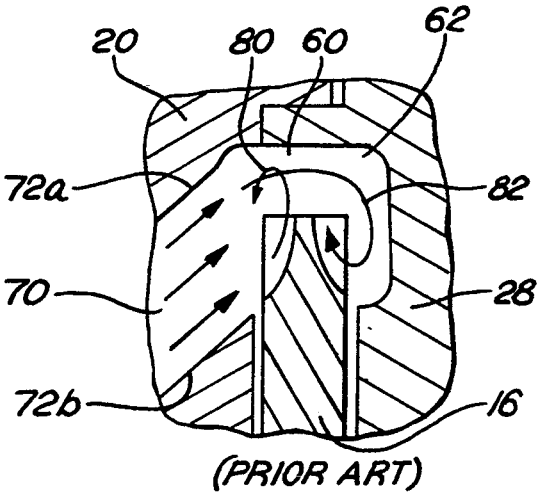
(PRIOR ART) FIG. 4
FIG. 4 is a cross-sectional view of a prior art inlet having parallel non-divergent sides.
Figure 5:
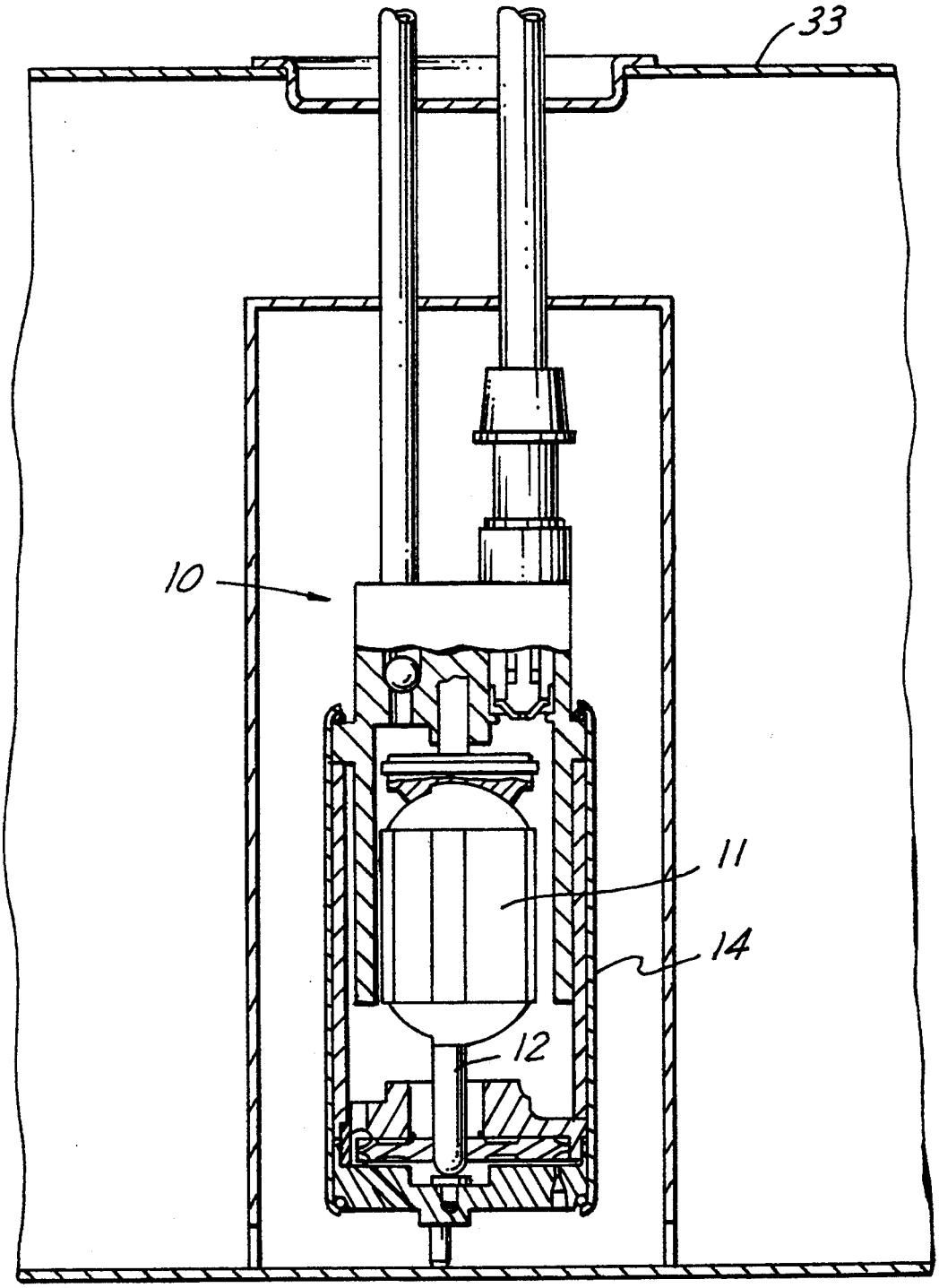

In an alternative embodiment shown in FIG. 3, side 42*a* is oriented at angle $\alpha$, preferably approximately 117 degrees, counterclockwise from a line 46 normal to the central axis of impeller 16. Side 42*b* is oriented at angle $\beta$, preferably approximately 129 degrees, counterclockwise from line 46. With such a configuration, sides 42*a* and 42*b* diverge at an end 41 of inlet 40 which communicates with the fuel tank (not shown) so that fuel flow is thus routed over primary vortices 50 formed in the pumping chamber 30 to pumping chamber 32.

In either embodiment, side 42*b* has a beveled portion 48 near vane grooves 17 which is parallel to the central axis of shaft 12. Beveled portion 48 simplifies manufacturing by allowing a tool (not shown) to be easily inserted into inlet 40 to trim the parting lines (not shown) formed during die casting of the part. The part cleaning process utilizing the tool, made possible by beveled portion 48, reduces the manufacturing trimming cost by a factor of seven.

The divergent inlet 40 of either embodiment can be die cast along with the pump cover 20, preferably in aluminum. Alternatively, pump cover 20 and inlet 40 can be integrally molded together out of a plastic material, such as acetyl.

Although the preferred embodiments of the present invention have been disclosed, various changes and modifications may be made without departing from the scope of the invention as set forth in the appended claims.

I claim:

1. A fuel pump for supplying fuel from a fuel tank to an automotive engine, comprising:

a pump housing;

a motor mounted within said housing having a shaft extending therefrom, said motor able to rotate said shaft upon application of an electrical current to said motor;

an impeller attached to said shaft for rotatably pumping fuel, said impeller having a plurality of vanes separated by a plurality of angularly shaped vane grooves;

a pump bottom mounted to said housing having an outlet therethrough in fluid communication with a motor chamber surrounding said motor, said pump bottom having an opening for allowing said shaft to pass through to connect to said impeller; and a pump cover mounted on an end of said housing and attached to said pump bottom with said impeller therebetween such that a pumping chamber is formed radially along an outer circumference of said pump cover and said pump bottom, and along the periphery of said impeller, said pumping chamber having a first section in said pump cover and a second section in said pump bottom in which primary vortices are formed when said impeller rotatably pumps fuel;

said pump cover having a fuel inlet therethrough in fluid communication with said fuel tank and with said pumping cheer, said inlet having a lower side and an upper side, said lower side angled tangentially to an arc formed by said angularly shaped vane grooves at a lowest point on said vane grooves, said upper side angled at approximately 10 to 12 degrees from a line parallel to said lower side such that said sides diverge at an end of said inlet which communicates with said fuel tank so that fuel flow is routed radially outwardly of primary vortices formed in said first section of said pumping chamber to said second section of said pumping chamber.

2. A fuel pump according to claim 1, wherein said lower side has a beveled portion in communication with said vane grooves and parallel to an axis through said shaft.

3. A fuel pump according to claim 1, wherein said inlet and said first section of said pumping chamber are integrally molded within said pump cover.

4. A fuel pump for supplying fuel from a fuel tank to an automotive engine, comprising:

a pump housing;

a motor mounted within said housing having a shaft extending therefrom, said motor able to rotate said shaft upon application of an electrical current to said motor;

an impeller attached to said shaft for rotatably pumping fuel, said impeller having a plurality of vanes separated by a plurality of angularly shaped vane grooves;

a pump bottom mounted to said housing having an outlet therethrough in fluid communication with a motor chamber surrounding said motor, said pump bottom having an opening for allowing said shaft to pass through to connect to said impeller; and a pump cover mounted on an end of said housing and attached to said pump bottom with said impeller therebetween such that a pumping chamber is formed radially along an outer circumference of said pump cover and said pump bottom, and along the periphery of said impeller, said pumping chamber having a first section in said pump cover and a second section is said pump bottom in which primary vortices are formed when said impeller rotatably pumps fuel;

said pump cover having a fuel inlet therethrough in fluid communication with said fuel tank and with said pumping chamber, said inlet having a lower side and an upper side, said lower side angled at approximately 129 degrees counterclockwise from a line perpendicular to said shaft, and said upper side angled at approximately 117 degrees counterclockwise from a line perpendicular to said shaft, such that said sides diverge at an end of said inlet which communicates with said fuel tank so that fuel flow is routed radially outward from said primary vortices formed in said first section of said pumping chamber to said second section of said pumping chamber.

5. A fuel pump according to claim 4, wherein said lower side has a beveled portion in communication with said vane grooves and parallel to an axis through said shaft.

6. A fuel pump according to claim 4, wherein said inlet and said first section of said pumping chamber are integrally molded within said pump cover.

* * * * *